US005156212A

United States Patent [19]

Bryant

[11] Patent Number: 5,156,212

[45] Date of Patent: Oct. 20, 1992

[54] METHOD AND SYSTEM FOR CONTROLLING HIGH PRESSURE FLOW, SUCH AS IN CONTAINMENT OF OIL AND GAS WELL FIRES

[76] Inventor: Thomas B. Bryant, P.O. Box 264, Ridgeway, Colo. 81432

[21] Appl. No.: 703,453

[22] Filed: May 21, 1991

[51] Int. Cl.[5] ..... A62C 3/00; B23B 4/08; E21B 29/08; E21B 35/00

[52] U.S. Cl. ..... 166/298; 166/55.1; 166/95; 166/379; 169/46; 169/69

[58] Field of Search ..... 166/55, 55.1, 55.2, 166/55.3, 297, 298, 95, 93, 90, 82, 380, 379; 169/43, 46, 69; 137/318

[56] References Cited

U.S. PATENT DOCUMENTS

| | | | |
|---|---|---|---|
| 1,851,894 | 3/1932 | Clough | 166/93 X |
| 1,879,160 | 9/1932 | Fowzer | 166/69 X |
| 1,949,672 | 3/1934 | Barrier | 166/93 X |
| 2,000,381 | 5/1935 | Duffy | 166/90 |
| 2,840,166 | 6/1958 | Eckel et al. | 137/318 X |
| 3,631,928 | 1/1972 | Dalzell | 166/90 X |
| 3,693,715 | 9/1972 | Brown | 166/93 X |
| 3,717,202 | 2/1973 | Burrow | 166/95 X |
| 3,738,424 | 6/1973 | Osmun et al | 166/55.1 X |
| 3,870,098 | 3/1975 | Houston | 166/55.1 |
| 3,887,011 | 6/1975 | Dokes et al. | 169/69 |
| 3,993,137 | 11/1976 | Hefetz | 169/69 X |
| 4,215,749 | 8/1980 | Dare et al. | 166/361 |
| 4,316,506 | 2/1982 | Poole | 169/69 |
| 4,553,589 | 11/1985 | Jennings et al. | 166/53 |
| 4,899,827 | 2/1990 | Poole | 169/69 |
| 5,076,311 | 12/1991 | Marschke | 166/55.1 X |

*Primary Examiner*—Stephen J. Novosad
*Attorney, Agent, or Firm*—Dorr, Carson, Sloan & Peterson

[57] ABSTRACT

A system for controlling and extinguishing oil and gas well fires, as well as a system for remotely controlling flow of a pipeline. The system of the present invention encapsulates a section of the pipe, such as beneath the oil and gas well. The encapsulated section of pipe is tapped to bleed off the maximum pressure and flow of the pipe which is diverted to a remote storage reservoir. The upper and lower sections of the encapsulated section of pipe are sealed to allow a valve to be installed in the pipe. The pipe is operated by remote-activation to control the flow to the surface. The flow can thus be stopped to allow the surface facilities to be rebuilt or replaced.

24 Claims, 5 Drawing Sheets

METHOD AND SYSTEM FOR CONTROLLING HIGH PRESSURE FLOW, SUCH AS IN CONTAINMENT OF OIL AND GAS WELL FIRES

BACKGROUND OF THE INVENTION

1. Field of the invention:

The present invention relates to the field of systems for controlling high pressure flows, particularly in containing and extinguishing oil and gas well fires.

2. Statement of the problem:

A problem of great concern in high pressure flow of fluid materials is in the control of such pipelines once flow has commenced. This is particularly of concern in the exploitation of energy sources such as oil and gas, due to the danger of high pressure blowouts and/or fires. The occurrence of a blowout or fire creates immediate risk of human safety, potentially enormous harm to the environment, great financial expense and loss of valuable energy resources.

There have been a number of prior attempts to control these blowouts. These are typically of two types. The first type require installation of control systems prior to the blowout occurring. Examples of these are blowout preventers which are stacked above the well casing and are designed to smash, pinch and scissor the drill pipe to hopefully close off the flow through the pipe. Also used are "Hydril" apparatus which are designed to close off the area around the drill pipe to prevent loss of the flow.

Other approaches include system as disclosed by Poole in U.S. Pat. No. 4,316,506, issued Feb. 23, 1982. This system injects a mixture of chemicals and gases into the flow of hydrocarbons in the drill pipe which are less flammable. Also issued to Poole in U.S. Pat. No. 4,899,827 is a system for injecting water as well.

U.S. Pat. No. 3,870,098, issued to Houston, discloses a remotely controllable subterranean oil well valve for sealing the pipe in the event of a fire or blowout. This device requires prior installation and shears the pipe to close it off should a fire or blowout occur. It may be possible to allow some regulated flow through the pipe by control of the shearing mechanism.

U.S. Pat. No. 4,553,589 issued to Jennings et al. discloses a subsurface safety valve control line which operates a subsurface valve to shut off the flow through the pipe should a fire or blowout occur.

U.S. Pat. No. 3,887,011 issued to Dokes et al. discloses a fire extinguisher system which uses a series of pipes and valves which are activated by the melting of an element in the case of fire to divert the flow to the atmosphere.

All of these systems require installation prior to a fire or blowout occurring. None are able to be installed once a fire or blowout has occurred. The only known approaches to containment after a fire or blowout has occurred requires the use of explosives to extinguish the flame and the dropping of heavy materials on the blowout to smother the flow and fire. These approaches are quite dangerous and are often ineffective in high pressure situations.

Therefore, a need exists for a system for containing oil and gas well fires as well as for controlling high pressure flow, especially from subterranean sources.

3. Solution to the problem:

The present invention solves these and other problems. The present invention provides a system for controlling high pressure flows of fluid material.

The system of the present invention has particular utility in extinguishing oil and gas well fires.

The system of the present invention can be installed after the fire or blowout has already began.

The present invention provides a system that can be installed with relatively little danger to human safety.

The present invention provides a system that can be used to control high pressure flows.

The present invention provides a system that can be installed on existing systems as well as new systems.

The present invention provides a system that enables surface facilities to be quickly repaired and production resumed.

These and other features of the invention will be evident from the ensuing description taken in conjunction with the drawings.

SUMMARY OF THE INVENTION

The present invention provides a system for remotely controlling flow of a pipeline. This system is particularly useful in controlling and extinguishing oil and gas well fires. The system of the present invention, in one preferred embodiment, involves excavating a pit at a safe distance from a oil and gas well fire or blowout. A tunnel is formed leading from the pit to a subterranean section of the pipe which is feeding the fire or blowout. A permanent enclosure is formed at this area around the section of pipe. The casing is then removed from around the pipe and the pipe is inspected for suitability for tapping.

An enclosure vessel is mounted around the section of pipe by clamping separable sections of the vessel in place and welding onto the pipe to seal the enclosed area. At least one bleed-off fixture is then attached to the lower end of the enclosure vessel. If necessary, a plurality of bleed-off fixtures can be attached. A diversion pipe is attached to each of the bleed-off fixtures and extended from the vessel through the tunnel to a remote storage reservoir. Each of the bleed-off fixtures include a drilling unit driven by a motor and gear drive assembly. The drilling unit taps into the lower section of the pipe within the enclosure vessel. This bleeds off the maximum pressure and flow from the pipe. The bleed-off fixtures includes valves to regulate the flow through the diversion pipes.

A lower drilling unit is attached to the enclosure vessel above the bleed-off fixture. The lower drilling unit includes a bearing portion which guides the drill and which seals off the pipe as the drill pierces through the pipe. An upper drilling unit is attached to the upper portion of the enclosure which also includes a bearing portion to seal off the pipe as the drill pierces through the pipe.

Once the upper and lower drilling units have sealed off the upper and lower portions of the enclosed section of pipe, the center portions of the vessel are removed from around the pipe. The exposed portion of pipe is cut and removed and a remotelyactivated valve is mounted therein to the pipe. The upper drilling unit and lower drilling unit are retracted and removed and the vessel capped at these locations. The bleed-off fixture can be removed and capped as well.

The valve is then activated by remote control to shut off the flow to the surface. This will extinguish the fire as well as stopping the blowout. The surface facilities can be repaired or replaced. The valve can be activated to resume the flow to the surface and production restarted. The permanent enclosure is then sealed off and the tunnel filled. The valve can still be remotely operated to control the subsurface flow to the surface production facilities.

These and other features of the invention will be evident from the ensuing description of a preferred embodiment taken in conjunction with the drawings.

DETAILED DESCRIPTION OF A PREFERRED EMBODIMENT

The present invention provides a system for controlling high pressure flows of fluid materials through a pipeline. This system is particularly useful for controlling and extinguishing oil and gas well fires, especially those fires involving high pressure environments and that are already ignited. The system of the present invention provides remote control of the oil and gas flow and will enable the surface facilities to be repaired or replaced and production resumed.

A preferred embodiment of the present embodiment is illustrated in FIGS. 1-5. It is to be expressly understood that this descriptive embodiment is for explanatory purposes only and is not meant to limit the scope of the claimed inventive concept. The system of the present invention is readily adaptable to the particular requirements of a variety of situations and conditions, for controlling high pressure flows of fluid materials.

Figure 1:
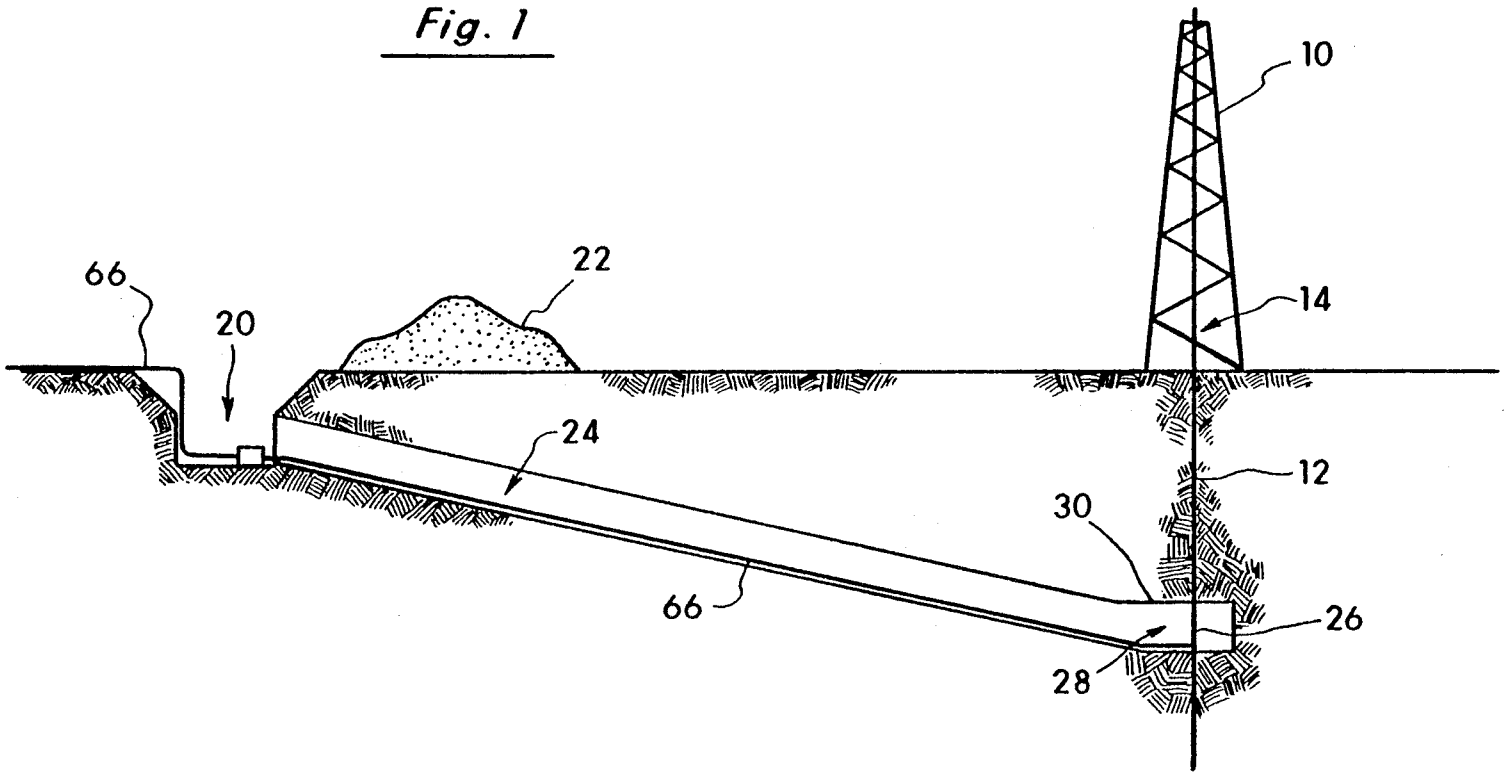
FIG. 1 is a schematic representation of a preferred embodiment of the present invention installed below an oil well.

A typical oil well 10 is illustrated in FIG. 1. Well 10 generally includes extensive lengths of pipe 12 extending below the surface to a subterranean source of oil and gas. The blowout and fire normally occurs at a location 14 above the surface. In prior attempts to extinguish the fire and control the blowout, operators would maneuver in close to the actual fire and attempt to extinguish the fire by the use of explosive charges or heavy equipment. Once the fire was extinguished, then control valves would be put in place to cap the blowout. This creates a high risk of danger to the operators as well as being largely unsuccessful in high pressure blowouts.

The present invention involves a sequential approach in controlling the flow to extinguish the fire. Once a fire has ignited, or a blowout has occurred, equipment is quickly mobilized to the site. This equipment is already fabricated and can be quickly assembled on site. As shown in FIG. 1, a tunnelling pit 20 is excavated at a distance from the fire site so the safety of the humans is not endangered. The excavated soil is piled adjacent pit 20 to form a heat shield 22 to add further protection. The sides of pit 20 are shored to prevent pit 20 from caving in and burying any workers in the pit.

A storage reservoir (not shown) is formed at a location remote from the fire site to prevent ignition of the oil which will be stored there as discussed below.

Once pit 20 has been formed, tunnelling equipment (not shown) is placed in pit 20. The equipment tunnels downward at a 15-25 per cent grade toward a subterranean section 26 of pipe 12 to form an access tunnel 24 to pipe section 26. The location of pipe section 26 is determined according to the geologic conditions of the surrounding area. This location as well as the site of the pit determines the grade of the tunnel. In the descriptive embodiment, for instance, pit 20 is formed at a distance between 100 to 200 feet from the oil well 10.

The area 28 around pipe section 26 is excavated and a permanent enclosure 30 is formed, by concrete or other materials. In the descriptive embodiment, permanent enclosure 30 is 20 feet wide and 12 to 14 feet tall. Other dimensions can be used as desired. Once permanent enclosure 30 has been formed, then the casing surrounding pipe section 26 is removed. Pipe section 26 is then prepared for welding. The condition and properties of pipe section 26 are examined to insure that the particular pipe section is suitable to be tapped.

Figure 2:
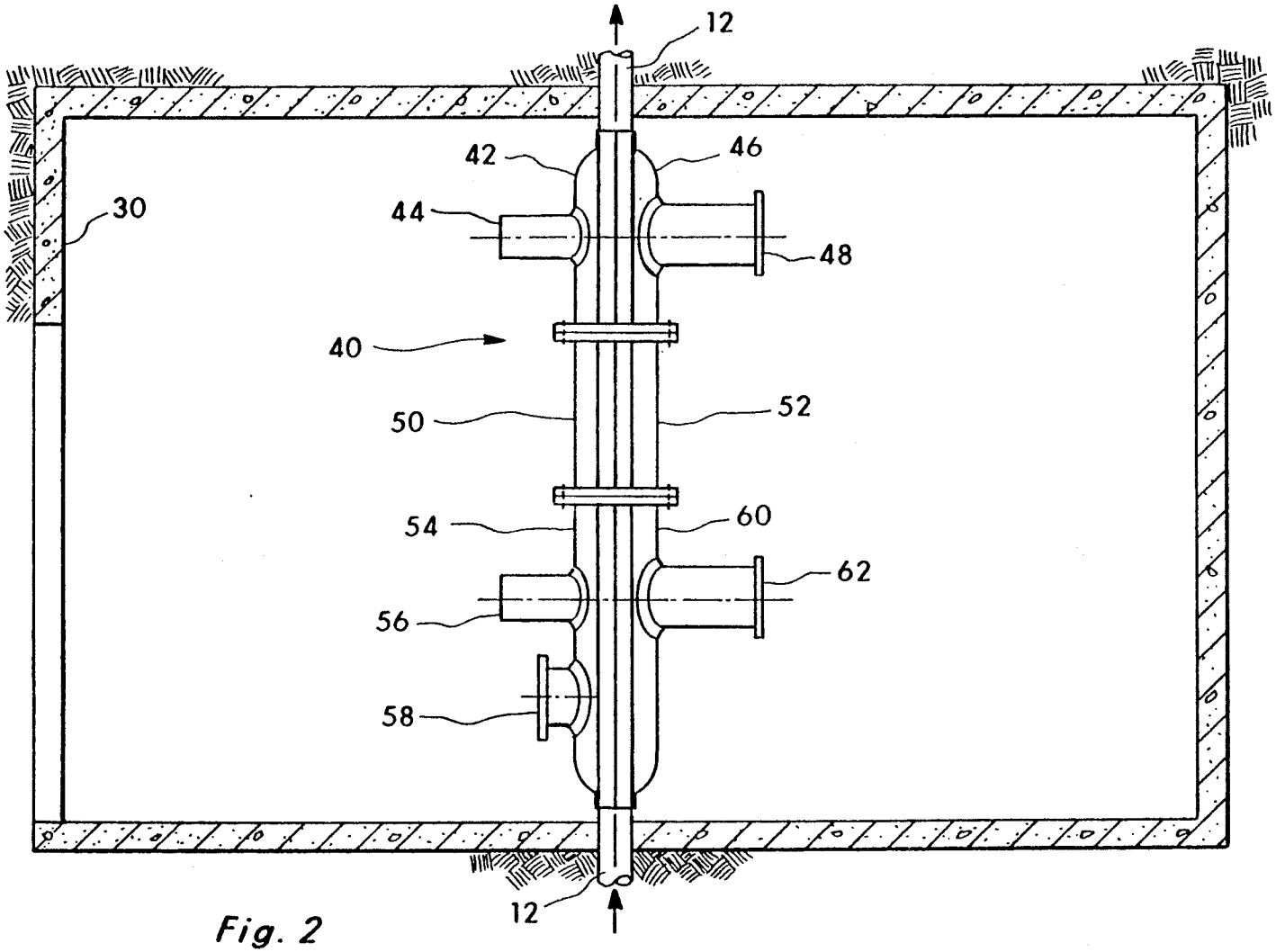
FIG. 2 is a cross-sectional view of the enclosure vessel of the present invention installed on a section of pipe.

Enclosure vessel 40 as shown in FIG. 2, is mounted onto pipe section 26. Vessel 40 includes a plurality of separable sections formed in a "clamshell" arrangement for quick assembly. These sections include left upper section 42 having guide portion 44, right upper section 46 having nozzle and flange assembly 48, left midsection 50, right midsection 52, left lower section 54 having guide portion 56 and nozzle and flange assembly 58, and right lower section 60 having nozzle and flange assembly 62.

These sections are assembled around the section of pipe 12 by clamping bolts to enclose this section of pipe 12 and then welded directly onto the pipe section to secure vessel 40 in place as well as to seal the inner enclosed area. The actual dimensions of the vessel are controlled by the size of the pipe, flow conditions, and the like, but since these parameters are largely standardized by the energy industry, these sections can be fabricated at an earlier time.

Figure 3:
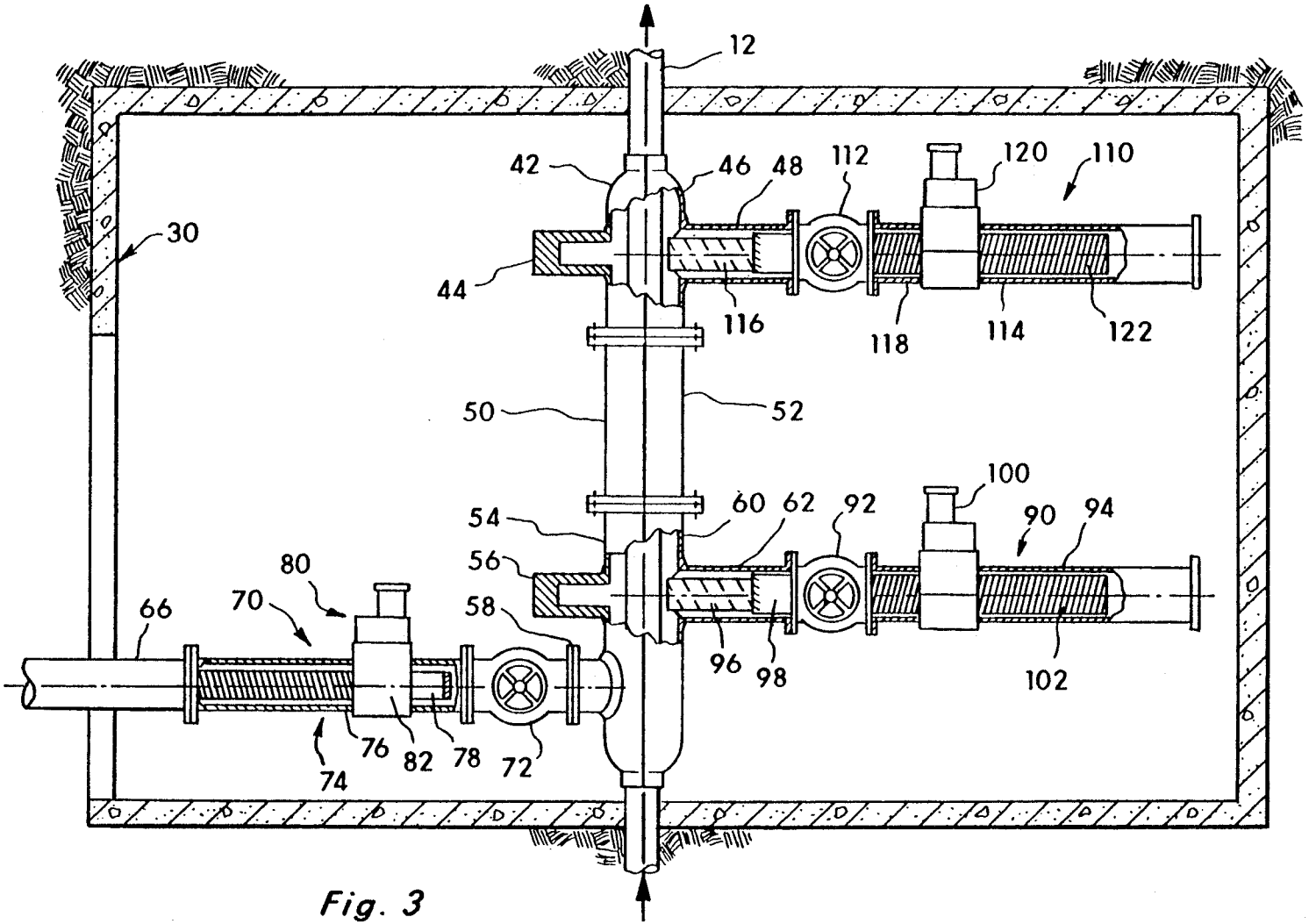
FIG. 3 is a cross-sectional view of the bleed-off fixture and sealing fixtures of the present invention.

Once enclosure vessel 40 is installed over pipe section 26, diversion pipe 66 as shown in FIG. 1, is installed, extending from the remote storage reservoir (not shown) through pit 20 into tunnel 24 to bleed-off fixture 70, shown in FIG. 3, in permanent enclosure 30. Bleed-off fixture 70, shown in FIG. 3, includes shut-off valve 72 mounted on nozzle and flange assembly 58 of lower section 54 of vessel 40. Valve 72 is an industrial standard valve capable of withstanding pressures of 5,000 to 10,000 psi or greater if required.

Drilling unit 74 is mounted on valve 72 with diversion pipe 66 attached to the other end of unit 74. Drilling unit 74 includes housing 76 with hollow core drill 78 mounted for rotation therein. Motor 80 and gear box assembly 82 are mounted on housing 76 to drive drill 78.

Figure 4:
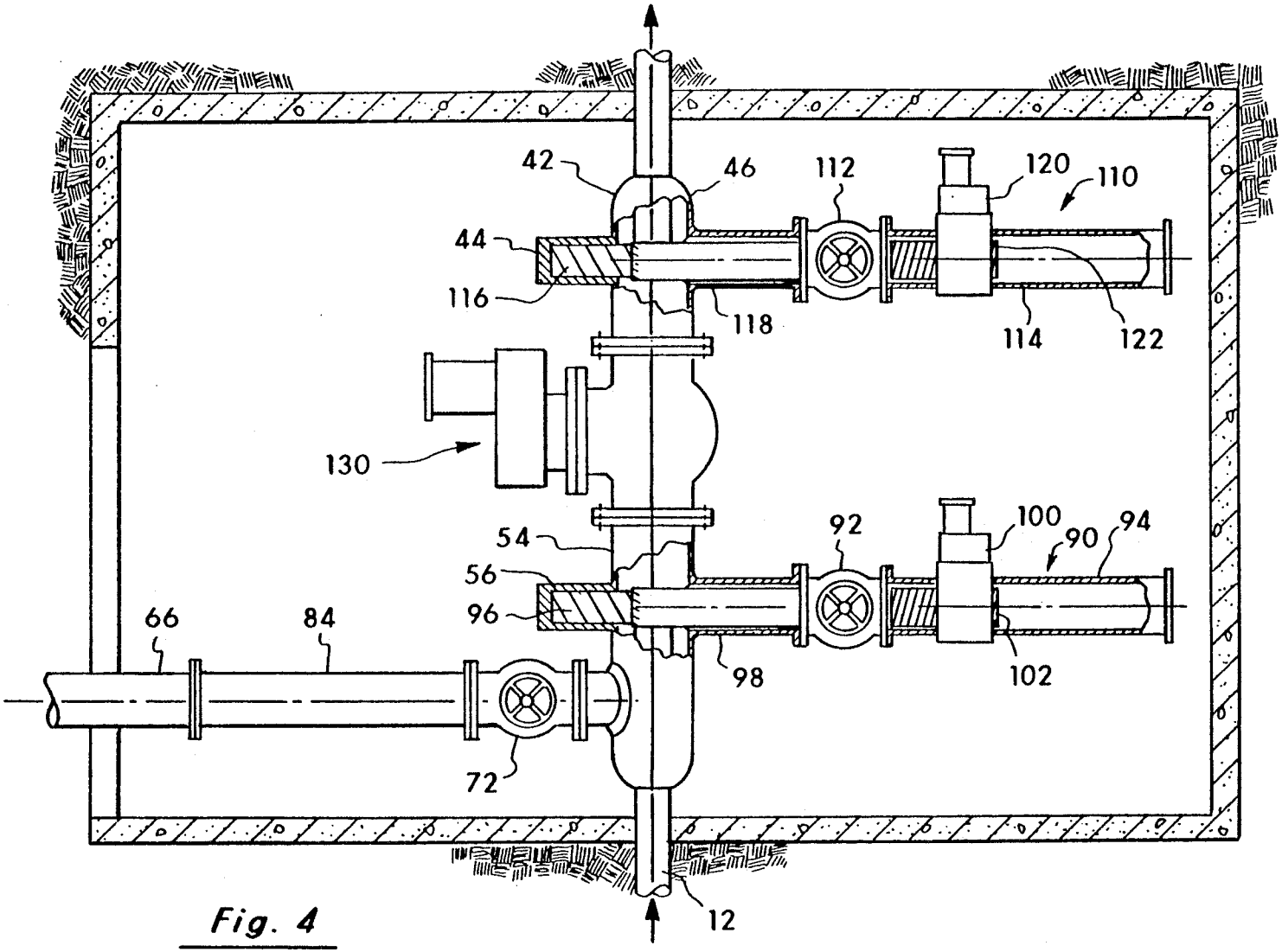
FIG. 4 is a cross-sectional view of the control valve/installed.

Drill motor 80 is activated to drive gear box assembly 80 forcing drill 78 to be rotated and linearly driven through valve 72 which is fully open. Pipe section 26 is pierced by hollow core drill 78 to allow the flow from the pipe 12 to be diverted through drill 78 into diversion pipe 66 into the remote storage reservoir. The flow diversion will bleed-off the pressure within the pipe 12 at pipe section 26. Valve 72 can be closed at this point to allow drilling unit 74 to be removed to be replaced by bleed pipe 84 as shown in FIG. 4.

Lower sealing fixture 90 is then secured to nozzle and flange assembly 62 of lower vessel section 60 as illustrated in FIG. 3. Lower sealing fixture 90 includes valve 92, of a type described above, and drilling unit 94. Drilling unit 94 includes drill 96, bearing 98, motor 100 and gear drive assembly 102. Bearing 98 serves to support drill 96 as drill 96 taps into pipe section 26. Motor 100 is activated to drive gear drive assembly to rotate drill 96 as well as infeed drill 96 to tap into pipe section 26. Drill 96 enters into guide portion 56 as drill 96 passes through pipe section 26. Bearing 98 is designed to seal off the inner area of pipe section 26 as drill 96 penetrates through pipe section 26. Once bearing 98 fully seals off pipe section 26, motor 100 is switched off.

Upper sealing fixture 110 is simultaneously mounted onto nozzle and flange assembly 48 of upper vessel section 46 as lower sealing fixture 90 is mounted onto nozzle and flange assembly 62.. Upper sealing fixture 110 is identical to lower sealing fixture 90. Valve 112 is attached to nozzle and flange assembly 48 with drilling unit 114 secured thereto. Drilling unit 114 includes drill 116, bearing 118, motor 120 and gear drive assembly 122. Motor 120 is activated to operate gear drive assembly 122 to rotate and infeed drill 116. Bearing 118 supports drill 116 as well as sealing off the inner area of pipe section 26. Drill II6 is guided by guide portion 44 of upper vessel section 42. Once the inner area of pipe section is sealed off by bearing 118, motor 120 is turned off.

At this juncture, not only has the flow been bled off by bleed-off fixture 70 to reduce the pressure within pipe 12, the upper and lower ends of section 26 within enclosure vessel 40 have sealed the pipe between upper sealing fixture 110 and lower sealing fixture 90. Vessel mid-portions 50, 52 are removed from vessel 40 to expose the pipe enclosed by these portions (not shown). Pipe 12 at this location is cut and removed. Valve 130, shown in FIG. 4, is installed in the pipe where the cut pipe has been removed and welded in place.

Valve 130 is operated by remote activation, such as by a solenoid. Once valve 130 is installed, it can be closed or shut-off to prevent flow through the valve and upper pipe.

Figure 5:
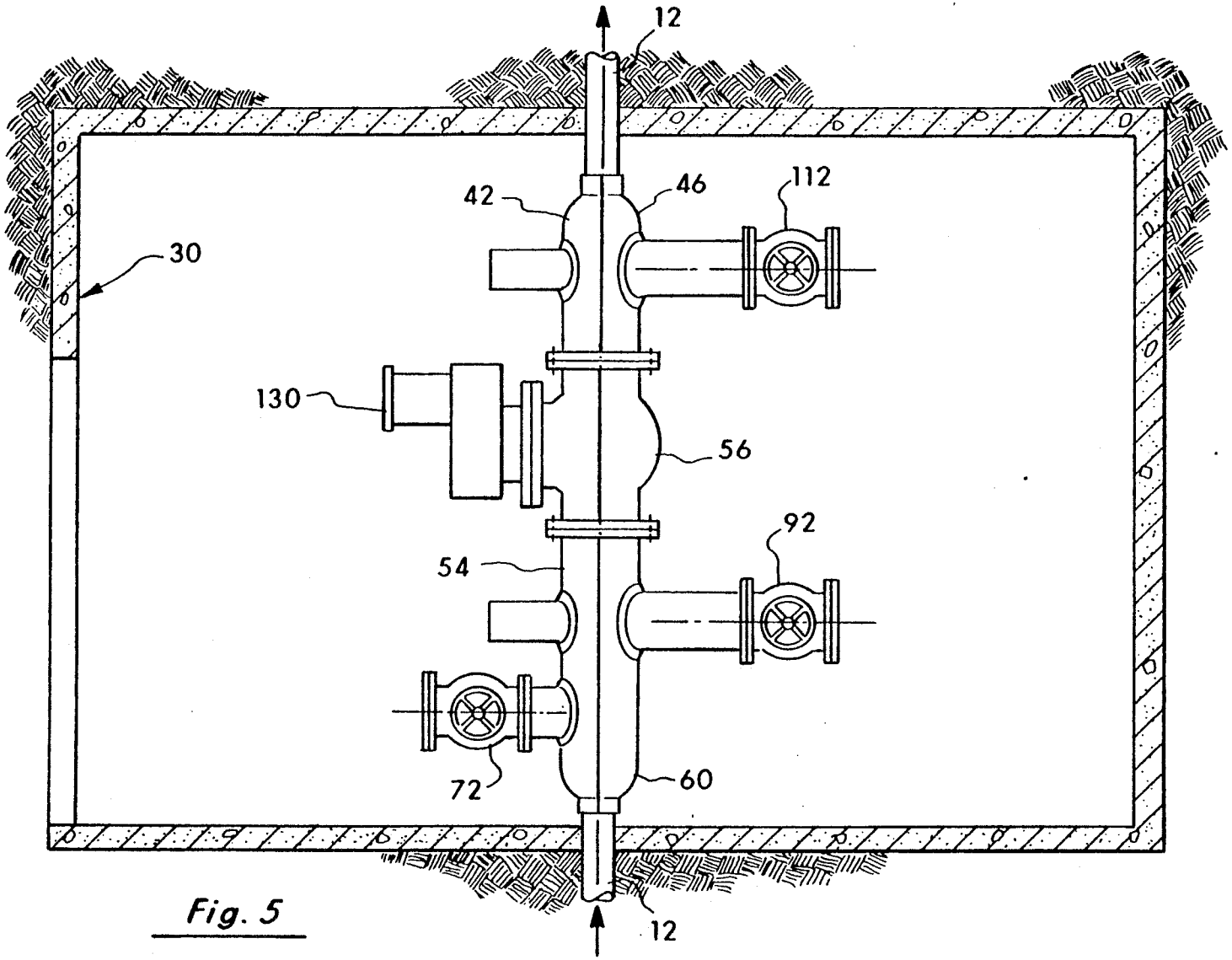
FIG. 5 is a cross-sectional view of the fixtures capped.

Motor 120 of upper sealing fixture is now activated to retract drill 116 and bearing 118 to unplug the upper section of pipe section 26. Drilling unit 114 is removed and valve 112 is capped, as shown in FIG. 5.

Motor 100 of lower drilling fixture is activated to retract drill 96 and bearing 98 to unplug the lower section of pipe section 26. Drilling unit 102 is removed and valve 92 is capped, as shown in FIG. 5.

Valve 72 can be shut off at this time. Bleed pipe 84 is removed and valve 72 capped as shown in FIG. 5.

Valve 130 then controls the flow of oil and gas through pipe 12 to the surface. The solenoid can be activated to shut off the flow to the surface. This will deprive the fire of fuel to extinguish it. The surface facilities can then be rebuilt or replaced as desired. Once the surface facilities are fully operational, the solenoid can be activated to open valve 130 so oil production can be resumed.

Permanent enclosure 30 can be sealed and the tunnel filled in. Valve 130 can still be operated by remote activation to allow the subsurface flow to be controlled. This provides a permanent valve structure, not only for future use in case of a blowout or fire, but also for normal operational use in the production of oil and gas.

It is to be expressly understood that the above description is for explanatory purposes only and is not meant to limit the claimed invention. The inventive concept is usable under a variety of conditions and situations and is designed to be readily adaptable as the need arises. For instance, the claimed inventive process can be altered according to different geographical and climatic conditions as well as geological considerations. The present invention is also considered to encompass use not only in fire and blowout conditions but as a remotely controlled valve for normal production use. Other embodiments under the claimed inventive scope include use in offshore drilling and production sites and in other uses not involving hydrocarbon exploitation. Other such embodiments and alterations are considered to be within the scope of the claimed inventive concept.

I claim:

1. A system for controlling the high pressure flow of fluid materials through a pipeline, said system comprising:

means for encapsulating a section of the pipeline through which the fluid materials are flowing;

first piercing means mounted on the lower end of said encapsulating means for piercing said encapsulated section of pipe;

bleed-off means attached to said first piercing means for diverting at least some of the flow from said pipe to a remote location to reduce the pressure in said pipe;

second piercing means mounted on said encapsulating means above said first piercing means for piercing said encapsulated section of pipe; and first sealing means removably attached to said second piercing means for selectively sealing off the lower end of said encapsulated section of pipe.

2. The system of claim 1 wherein said system further comprises:

third piercing means mounted on the upper end of said encapsulating means for piercing said encapsulated section of pipe;

second sealing means removably attached to said third piercing means for selectively sealing off the upper end of said encapsulated section of pipe; and valve means adapted for mounting between said first sealing means and said second sealing means for controlling the flow through said pipe once said first sealing means and said second sealing means are removed.

3. The system of claim 1 wherein said encapsulating means include a vessel having separable sections for ease of mounting onto said section of pipe, said sections include two upper sections, two mid-section sections, and two lower sections, said encapsulating means further including means for sealing said vessel on said section of pipe.

4. The system of claim 1 wherein said first piercing means includes tapping means to pierce said encapsulated section of pipe, guide means to pilot said tapping means, a motor driven gear box assembly to drive said tapping means, a valve mounted between said tapping means and said encapsulating means for controlling the flow out of said encapsulating means; and said bleed-off means include a conduit attached to said first piercing means to conduct said flow to said remote location.

5. The system of claim 1 wherein said second piercing means include tapping means for piercing said encapsulated section of pipe, guide means for piloting said tapping means, and motor-driven gear box assembly for driving said tapping unit;

said first sealing means include plugging means mounted over the rear portion of said tapping unit to seal off said encapsulated section of pipe as said tapping unit pierces through said encapsulated section of pipe; and shut-off valve means for controlling the flow once said first sealing means are removed and said tapping means are removed.

6. The system of claim 2 wherein said third piercing means include tapping means for piercing said encapsulated section of pipe, guide means for piloting said tapping means, and motor-driven gear box assembly for driving said tapping unit;

said second sealing means include a plugging unit mounted over the rear portion of said tapping unit to seal off said encapsulated section of pipe as said tapping unit pierces through said encapsulated section of pipe; and shut-off valve means for controlling the flow once said second sealing means are removed and said tapping means are removed.

7. The system of claim 2 wherein said valve means include means for remotely activating the operation of said valve means to control flow through said pipe.

8. The system of claim 1 wherein said system further comprises:

bleed pipe means for replacing said first piercing means once said first piercing means has pierced said encapsulated section of pipe.

9. The system of claim 2 wherein said system further comprises:

capping means for capping off the area of said encapsulated section of pipe that had been pierced by said first piercing means when said bleed-off means are no longer necessary.

10. The system of claim 5 wherein said system further comprises:

capping means for capping said shut-off valve means once said shut-off valve means is no longer needed.

11. The system of claim 6 wherein said system further comprises:

capping means for capping said shut-off valve means once said shut-off valve means is no longer needed.

12. A system for controlling the flow of fluids through a pipeline, said system comprising:

means for encapsulating a section of the pipe through which fluid materials are being transported;

first piercing means mounted on the lower end of said encapsulating means for piercing said encapsulated section of pipe;

bleed-off means attached to said first piercing means for diverting at least some of the flow from said pipe to a remote location to lower the pressure of said pipe;

second piercing means mounted on said encapsulating means above said first piercing means for piercing said encapsulated section of pipe;

first sealing means removably attached to said second piercing means for selectively sealing off the lower end of said encapsulated section of pipe;

third piercing means mounted on the upper end of said encapsulating means for piercing said encapsulated section of pipe;

second sealing means removably attached to said third piercing means for selectively sealing off the upper end of said encapsulated section of pipe; and valve means adapted for mounting on said pipe between said first sealing means and said second sealing means for controlling the flow through said pipe once said first sealing means and said second sealing means are removed.

13. The system of claim 12 wherein said encapsulating means include a vessel having separable sections for ease of mounting onto said section of pipe, said sections include two upper sections, two mid-section sections, and two lower sections, said encapsulating means further including means for sealing said vessel on said section of pipe.

14. The system of claim 12 wherein said first piercing means includes first tapping means to pierce said encapsulated section of pipe, guide means to pilot said first tapping means, a motor driven gear box assembly to drive said first tapping means, a valve mounted between said first tapping means and said encapsulating means for controlling the flow out of said encapsulating means; and said bleed-off means include a conduit attached to said first piercing means to conduct said flow to said remote location.

15. The system of claim 12 wherein said second piercing means include second tapping means for piercing said encapsulated section of pipe, guide means for piloting said second tapping means, and motor-driven gear box assembly for driving said second tapping means;

said first sealing means include a plugging unit mounted over the rear portion of said second tapping means to seal off said encapsulated section of pipe as said second tapping means pierces through said encapsulated section of pipe;

shut-off valve means for controlling the flow once said first sealing means are removed and said second tapping means are removed;

said third piercing means include third tapping means for piercing said encapsulated section of pipe, guide means for piloting said third tapping means, and motor-driven gear box assembly for driving said third tapping unit;

said second sealing means include a second plugging unit mounted over the rear portion of said third tapping unit to seal off said encapsulated section of pipe as said third tapping means pierces through said encapsulated section of pipe; and shut-off valve means for controlling the flow once said second sealing means are removed and said third tapping means are removed.

16. The system of claim 12 wherein said valve means include means for remotely activating the operation of said valve means to control flow through said pipe.

17. The system of claim 13 wherein said system further comprises:

bleed pipe means for replacing said first piercing means once said first piercing means has pierced said encapsulated section of pipe.

18. The system of claim 16 wherein said system further comprises:

capping means for capping off the area of said encapsulated section of pipe that had been pierced by said first piercing means when said bleed-off means are no longer necessary.

19. The system of claim 17 wherein said system further comprises:

capping means for capping said first and second shut-off valve means once said first and second shut-off valve means are no longer needed.

20. A method for controlling flow through a pipe, particularly for containing oil and gas well fires, said method comprising the steps of:

installing an enclosure vessel around said section of pipe;

mounting a first piercing unit having a bleed-off assembly onto said enclosure vessel;

installing a diversion pipe connected to said bleed-off assembly to a remote holding site;

piercing said section of pipe with said first piercing unit;

bleeding off maximum pressure from said section of pipe by diverting the flow from said pipe through said diversion pipe to said remote holding site;

installing a first drilling unit on said vessel above said bleed-off assembly;

mounting a first plugging unit on said first drilling unit;

drilling through said section of pipe with said first drilling unit; and plugging said section of pipe with said first plugging unit.

21. The method of claim 20 wherein said method further comprises the steps of:

mounting a second drilling unit on said vessel spaced above said first drilling unit;

attaching a second plugging unit on said second drilling unit;

drilling through said section of pipe with said second drilling until;

plugging said section of pipe with said second plugging unit at a location above said first plugging unit;

removing a center portion of said vessel between said first plugging unit and said second plugging unit from said section of pipe;

removing a portion of said section pipe at said area of said center portion of said vessel;

installing a remotely-activated valve in said section of pipe where said center portion has been removed;

removing said first plugging unit and said second plugging unit;

closing off said bleed-off unit to stop the flow through said diversion pipe; and controlling the flow through said pipe by operation of said remotely-activated valve.

22. The method of claim 20 wherein said method further comprises prior to installing said enclosure vessel, the steps of:

excavating a tunnelling pit at a predetermined site from the site of the fire;

tunnelling from said pit to a subterranean section of the pipe providing the flow of oil to the fire site; and installing said enclosure vessel around a subterranean section of said pipe.

23. The method of claim 22 wherein said method further includes after the step of installing said remotely-activated valve, the steps of:

rebuilding the surface containment facilities; and opening said remotely-activated valve to resume surface production.

24. A method for containing oil and gas well fires as well as controlling the flow of fluids from a remote source, said method comprising the steps of:

mobilizing equipment to the site of the fire;

excavating a tunnelling pit at a predetermined site from said fire site;

forming a heat shield by placing the soil excavated from said pit between said fire site and said pit;

forming a tunnel from said pit to a subterranean section of the pipe that is furnishing flow of the fluid to the fire site;

forming an enclosure around said section of pipe;

removing the casing from around said section of pipe;

inspecting said section of pipe for suitability of tapping;

installing an enclosure vessel around said section of pipe;

mounting a bleed-off fixture on said enclosure vessel;

extending a diversion pipe from said bleed-off fixture to a remote holding reservoir;

attaching a first piercing assembly on said bleed-off fixture;

attaching a bleed-off assembly on said bleed-off fixture;

piercing said section of pipe with first piercing assembly;

bleeding off the maximum pressure of said pipe by diverting to said remote holding reservoir through said diversion pipe;

attaching a lower drilling unit to said vessel;

attaching a first plugging unit on said lower drilling unit;

drilling into said section of pipe with said lower drilling unit;

plugging a lower portion of said section of pipe with said first plugging unit;

attaching an upper drilling unit to said vessel;

attaching a second plugging unit on said upper drilling unit;

drilling into said section of pipe with said upper drilling unit;

plugging an upper portion of said section with said second plugging unit;

removing a center portion of said vessel from said section of pipe;

removing a portion of said section of pipe at said center portion of vessel;

installing a remotely-activated valve in said section of pipe that has been removed;

retracting said first plugging unit and said second plugging unit from said section of pipe;

closing off said bleed-off unit to stop flow through said diversion pipe;

activating said remotely-activated valve to control the flow to the surface;

rebuilding the surface containment facilities;

opening said remotely-activated valve to resume surface production.

* * * * *